US007079002B1

(12) United States Patent
Yu

(10) Patent No.: US 7,079,002 B1
(45) Date of Patent: Jul. 18, 2006

(54) SAFETY SWITCH

(76) Inventor: Tsung-Mou Yu, No. 4, Alley 2, Lane 23, Sec. 3, Pa Te Road, Panchiao, Taipei (TW)

( * ) Notice: Subject to any disclaimer, the term of this patent is extended or adjusted under 35 U.S.C. 154(b) by 0 days.

(21) Appl. No.: 11/093,093

(22) Filed: Mar. 29, 2005

(51) Int. Cl.
*H01H 71/16* (2006.01)
*H01H 61/04* (2006.01)

(52) U.S. Cl. ..... 337/59; 337/85

(58) Field of Classification Search ..... 337/37, 337/52–60, 66, 67, 70, 72, 74, 75, 126, 85; 29/622; 200/339, 401, 553
See application file for complete search history.

(56) References Cited

U.S. PATENT DOCUMENTS

| | | | | |
|---|---|---|---|---|
| 5,933,069 | A * | 8/1999 | Huang | 337/66 |
| 6,452,125 | B1 * | 9/2002 | Yu | 200/553 |
| 6,577,221 | B1 * | 6/2003 | Wang | 337/59 |
| 6,822,179 | B1 * | 11/2004 | Huang | 200/401 |
| 6,864,453 | B1 * | 3/2005 | Yu | 200/520 |
| 2005/0140489 | A1 * | 6/2005 | Kuo | 337/66 |

* cited by examiner

*Primary Examiner*—Lisa Lea-Edmonds
*Assistant Examiner*—Corey Broussard

(57) ABSTRACT

A switch device includes a body with a switch member pivotably connected to a top thereof and two terminals extend through an underside of the body. A first contact point is connected to one of the terminals and a bi-metallic plate has a first end fixed to the other terminal. A second contact point is connected to an underside of a second end of the bi-metallic plate and located above the first contact point. A pull member has an upper end pivotably connected to the switch member and a lower end of the pull member supports the underside of the second end of the bi-metallic plate. An upper end of a push member is pivotably connected to the switch member and a lower end of the push member is in contact with the bi-metallic plate. A spring is biased between the push member and the body so as to provide a push force to the push member. The push member pushes the bi-metallic plate toward the second terminal when pivoting the switch to "ON" position, and the pull member lifts the bi-metallic plate when pivoting the switch to "ON" position. The push member is pushed by the deformation of the bi-metallic plate to pivot the switch to "OFF" position when the switch device is overloaded.

4 Claims, 3 Drawing Sheets

(OFF)

(ON)

SAFETY SWITCH

FIELD OF THE INVENTION

The present invention relates to a safety switch including a pull member for lifting a free end of the bi-metallic plate and a push member for pushing the free end of the bimetallic plate to contact one of the two terminals to form "OFF" and "ON" status.

BACKGROUND OF THE INVENTION

A conventional switch device, especially for those switches using bimetallic plate to prevent it from being burned when the switch device is overloaded, generally includes a bi-metallic plate which is deformed when there is overload so as to separate the two contact points respectively located on the bi-metallic plate and one of the two terminals. Some inherent shortcomings for these conventional safety switch devices are found. Firstly, there are too many parts involved in the safety switch device and it is time consuming to assemble the switch device, and this increases the cost of the products. Secondly, the parts may be arranged inaccurately to impact the deformation of the bi-metallic plate. Once the bi-metallic plate is deformed to cut off the circuit, because of the improper arrangement of the parts as mentioned above, the bi-metallic plate could deform to reconnect the two contact points to connect the circuit again. Thirdly, because of the inaccuracy of the deformation of the bi-metallic plate, the switch member does not switch to the "OFF" position after the bi-metallic plate is deformed to cut off the circuit. Therefore, the user cannot distinguish the status of the switch device by the position of the switch member.

Therefore, it is desired to have a switch device wherein the bi-metallic plate is well positioned when the switch device is in "ON" and "OFF" positions.

SUMMARY OF THE INVENTION

In accordance with an aspect of the present invention, there is provided a switch device that comprises a body with a top opening for a switch member pivotably engaged therewith and two slots defined through an underside of the body so that a first terminal and a second terminal extend through the two slots. A first contact point is connected to the second terminal. A bi-metallic plate has an end fixed to the first terminal and a second contact point is connected to an underside of a second end of the bi-metallic plate. The second contact point is located above the first contact point. A link assembly includes a pull member and a push member, wherein an upper end of the pull member is pivotably connected to the switch member and a lower end of the pull member supports the underside of the second end of the bimetallic plate. An upper end of the push member is pivotably connected to the switch member and a lower end of the push member is in contact with the bi-metallic plate. A spring is biased between the push member and the body so as to provide a push force to the push member.

The main object of the present invention is to provide a safety switch that uses a link assembly connected with the switch member to effectively control the bimetallic plate to move between "ON" and "OFF" positions.

Another object of the present invention is to provide a safety switch wherein the push member of the link assembly is pushed to pivot the switch member to "OFF" position when the bi-metallic plate is deformed as a result of overload so that the user can distinguish the status of the switch device easily.

The present invention will become more obvious from the following description when taken in connection with the accompanying drawings, which show, for purposes of illustration only, a preferred embodiment in accordance with the present invention.

DETAILED DESCRIPTION OF THE PREFERRED EMBODIMENT

Figure 1:
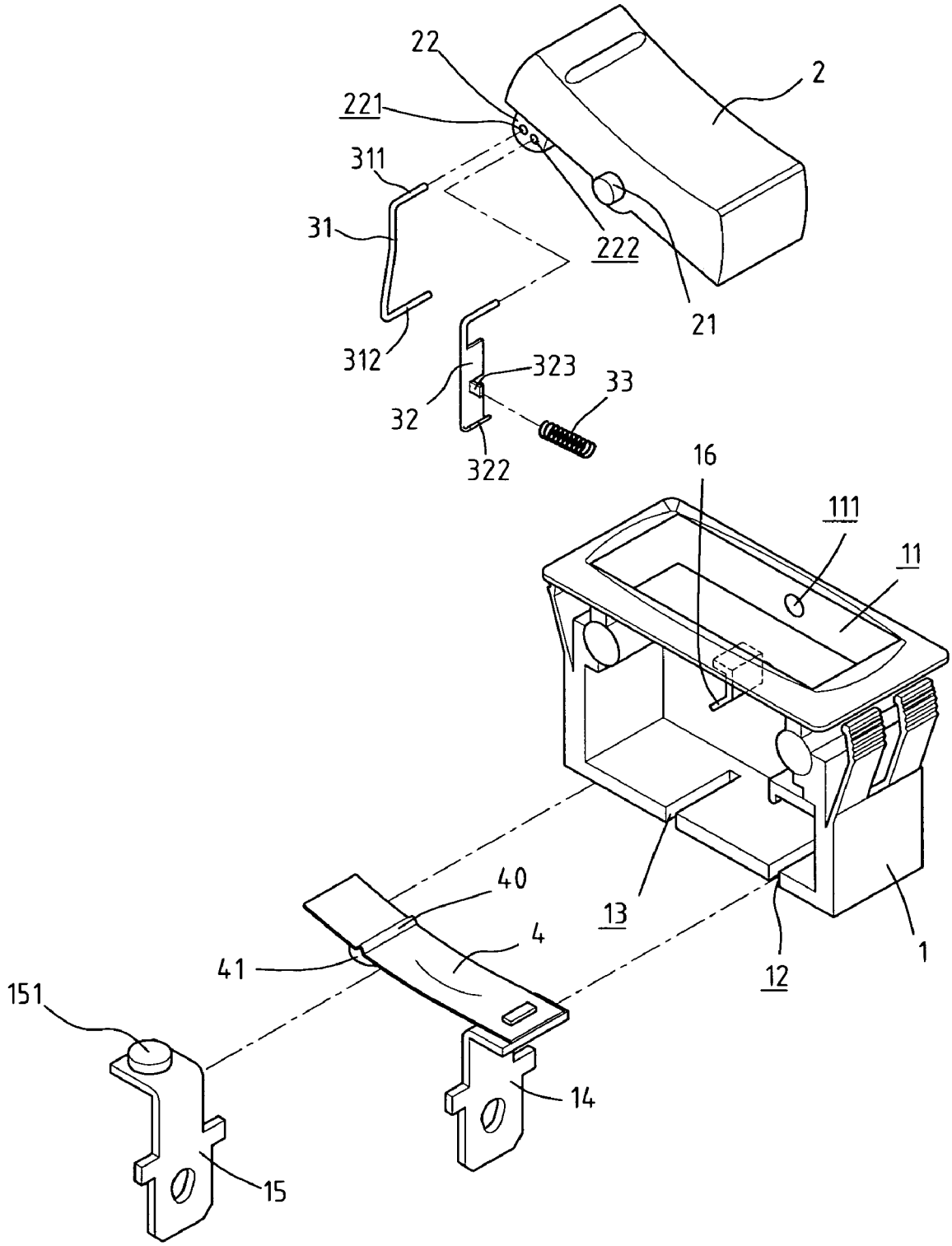
FIG. 1 is an exploded view of the safety switch device in accordance with the present invention.
Figure 2:
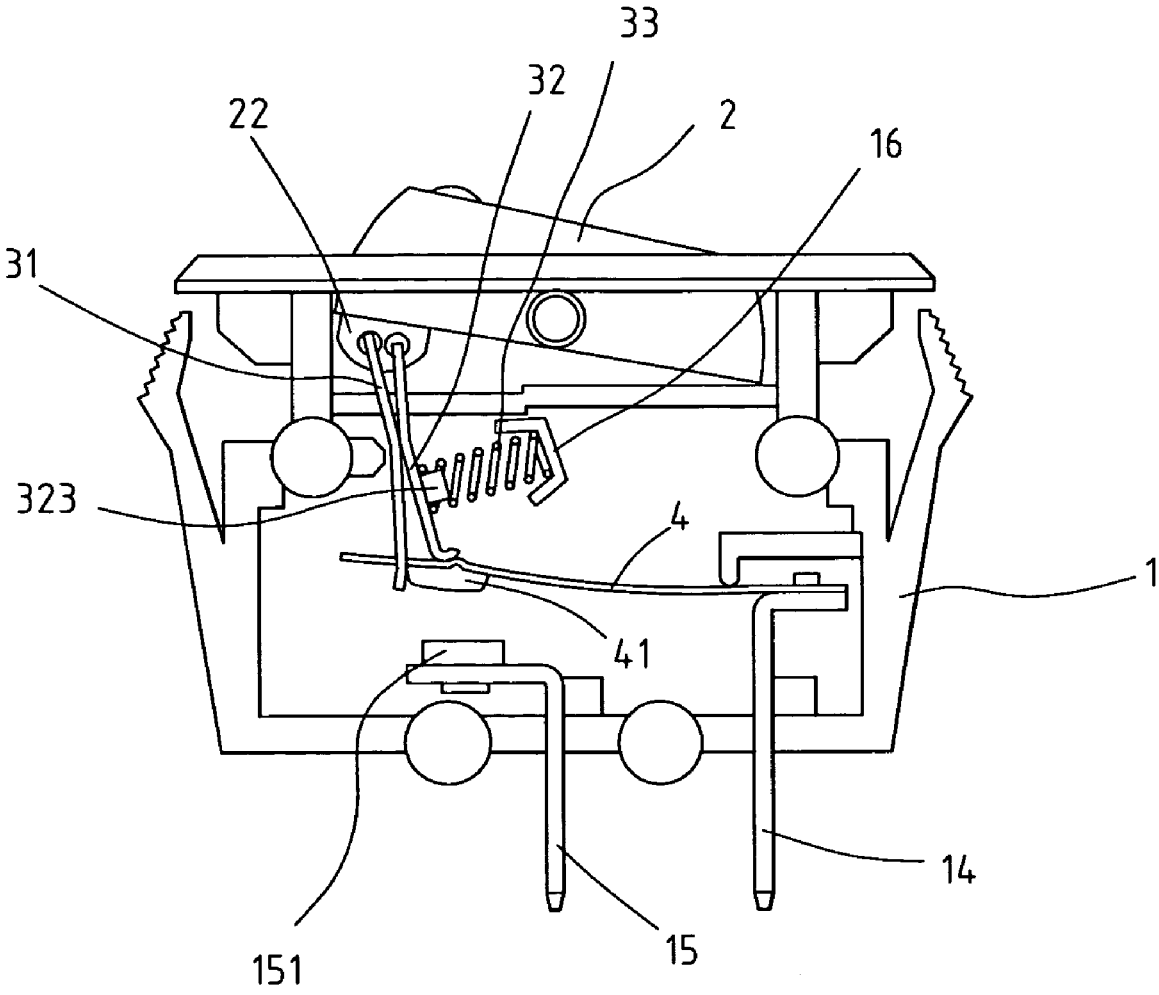
FIG. 2 shows the bi-metallic plate is in "OFF" position of the safety switch of the present invention.

Referring to the drawings and in particular FIGS. 1 and 2, a safety switch device comprises a body 1 with a top opening 11 and two pivot holes 111 are defined through two opposite walls of the body 1. A switch member 2 is pivotably engaged with the top opening 11 of the body 1 by pivotally engaging two pivots 21 extending from two sides of the switch member 2 with the two pivot holes 111. A protrusion 22 extends from an underside of an end of the switch member 2 and includes two receiving holes 221, 222. Two slots 12, 13 are defined through an underside of the body 1 so that a first terminal 14 and a second terminal 15 extend through the two slots 12, 13. A first contact point 151 is connected to the second terminal 15 and a bi-metallic plate 4 has a first end fixed to a top of the first terminal 14 and a second contact point 41 connected to an underside of a second end of the bi-metallic plate 4. The second contact point 41 is located above the first contact point 151. An extension 16 extends from an inside of the body 1.

A link assembly 3 includes a pull member 31 and a push member 32. A first link 311 extends from an upper end of the pull member 13 and is pivotably engaged with the receiving hole 221 in the switch member 2 and a second link 312 extends from the lower end of the pull member 31. The second end of the bi-metallic plate 4 is supported on the second link 312. A third link extends from the upper end of the push member 32 and is pivotably engaged with the receiving hole 322, and a bending portion 322 is formed on and across the entire lower end of the push member 32 and in contact, with a top surface of the bi-metallic plate 4. The bi-metallic plate 4 includes a ridge 40 extending from the top thereof across the entire bi-metallic plate 4 laterally and the bending portion 322 of the push member 32 is in contact with one of two sides of the ridge 40. A boss 323 extends from a side of the push member 32 and one end of a spring 33 is mounted to the boss 323 and the other end of the spring 33 is engaged with the extension 16 of the body 1. The spring 33 can be a spiral spring that provides a push force to the push member 32 toward the pull member 31.

Figure 3:
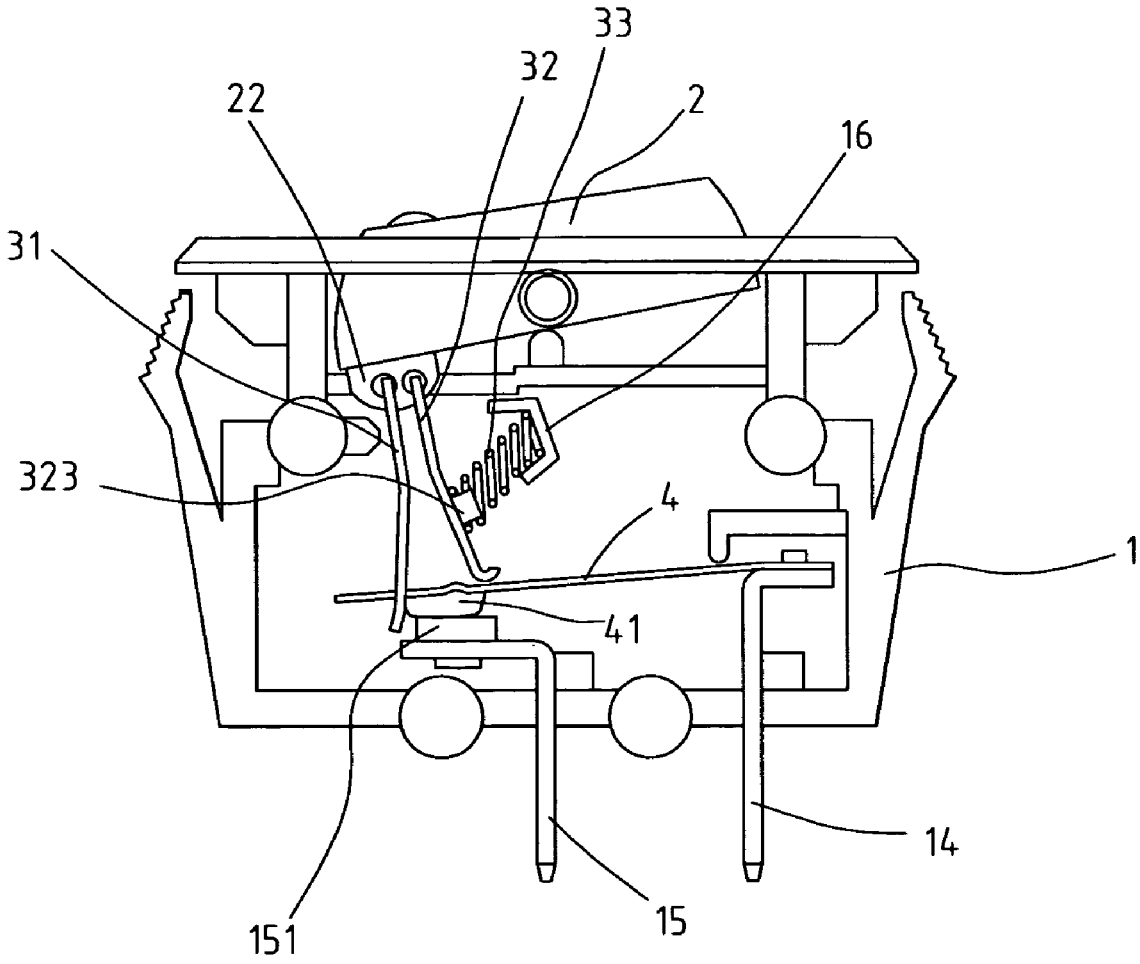
FIG. 3 shows the bi-metallic plate is in "ON" position of the safety switch of the present invention.

As shown in FIG. 2, when the switch device is in "OFF" status, the right end of the switch member 2 is lowered and the protrusion 22 on the left end of the switch member 2 is located at a high position so that the pull member 31 lifts the second end of the bi-metallic plate 4 away from the second contact point 151. As shown in FIG. 3, when the switch device is in "ON" position, the left end of the switch member 2 is pushed and the bending portion 322 of the push member

32 pushes the second end of the bi-metallic plate 4 downward, the bending portion 322 moves over the ridge 40 from the left side of the ridge 40 to the right side of the ridge 40. The first and second contact points 41, 151 are in contact with each other so that circuit is in "ON" status. When the switch device is in "ON" position and there is overload current, the bi-metallic plate 4 is deformed upward and the first and second contact points 41, 151 are separated so that the circuit is cut off. The deformation of the bi-metallic plate 4 pushes the push member 32 upward to pivot the switch member 2 to "OFF" position.

While we have shown and described the embodiment in accordance with the present invention, it should be clear to those skilled in the art that further embodiments may be made without departing from the scope of the present invention.

What is claimed is:

1. A switch device comprising:

a body with a top opening and two slots defined through an underside of the body, a first terminal and a second terminal extending through the two slots and a first contact point connected to the second terminal;

a bi-metallic plate having a first end fixed to the first terminal and a second contact point connected to an underside of a second end of the bimetallic plate, the second contact point located above the first contact point;

a switch member pivotably engaged with the top opening of the body; and a link assembly including a pull member and a push member, an upper end of the pull member pivotably connected to the switch member and a lower end of the pull member supporting the underside of the second end of the bimetallic plate, an upper end of the push member pivotably connected to the switch member and a lower end of the push member being in contact with the bi-metallic plate, a spring biased between the push member and the body so as to provide a push force to the push member;

wherein the push member has a single bending portion formed across the entire lower end of the push member, the bi-metallic plate has a single ridge extending upward across the entire bi-metallic plate and the bending portion of the push member is in contact with a top surface of the bi-metallic plate at one of two sides of the ridge.

2. The device as claimed in claim 1, wherein a protrusion extends from an underside of an end of the switch member and includes two receiving holes, a first link extends from the upper end of the pull member and is pivotably engaged with one of the receiving holes, a second link extends from the lower end of the pull member and the second end of the bi-metallic plate is supported on the second link, a third link extends from the upper end of the push member and is pivotably engaged with the other receiving holes, a boss extends from a side of the push member and one end of the spring is mounted to the boss and the other end of the spring contacts the body.

3. The device as claimed in claim 1, wherein the spring is a spiral spring.

4. The device as claimed in claim 1, wherein two pivot holes are defined through two opposite walls of the body and two pivots extend from two sides of the switch member, the two pivots being pivotably engaged with the two pivot holes.

* * * * *